US010588193B2

(12) United States Patent
Lee et al.

(10) Patent No.: US 10,588,193 B2
(45) Date of Patent: Mar. 10, 2020

(54) LED MODULE AND LIGHTING APPARATUS

(71) Applicant: SAMSUNG ELECTRONICS CO., LTD., Suwon-si (KR)

(72) Inventors: Bong Jin Lee, Hwaseong-si (KR); June Jang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 4 days.

(21) Appl. No.: 16/050,438

(22) Filed: Jul. 31, 2018

(65) Prior Publication Data

US 2019/0234567 A1 Aug. 1, 2019

(30) Foreign Application Priority Data

Jan. 31, 2018 (KR) ..... 10-2018-0012259

(51) Int. Cl.
*H05B 33/08* (2006.01)
*F21V 23/00* (2015.01)

(52) U.S. Cl.
CPC ..... *H05B 33/0857* (2013.01); *F21V 23/001* (2013.01); *H05B 33/0845* (2013.01)

(58) Field of Classification Search
CPC ... F21S 4/20; H05B 33/0857; H05B 33/0845; H05B 33/0815; F21V 23/001
See application file for complete search history.

(56) References Cited

U.S. PATENT DOCUMENTS 6,372,608 B1 4/2002 Shimoda et al.
6,645,830 B2 11/2003 Shimoda et al.
RE38,466 E 3/2004 Inoue et al.
6,818,465 B2 11/2004 Biwa et al.
6,818,530 B2 11/2004 Shimoda et al.
6,858,081 B2 2/2005 Biwa et al.
6,967,353 B2 11/2005 Suzuki et al.
7,002,182 B2 2/2006 Okuyama et al.
7,084,420 B2 8/2006 Kim et al.
7,087,932 B2 8/2006 Okuyama et al.
7,154,124 B2 12/2006 Han et al.
7,208,725 B2 4/2007 Sherrer et al.
7,288,758 B2 10/2007 Sherrer et al.
7,319,044 B2 1/2008 Han et al.
7,501,656 B2 3/2009 Han et al.
(Continued)

FOREIGN PATENT DOCUMENTS

KR 10-2013-0141098 A 12/2013
KR 10-1648788 B1 8/2016
KR 10-1737427 B1 5/2017

*Primary Examiner* — Raymond R Chai
(74) *Attorney, Agent, or Firm* — Sughrue Mion, PLLC

(57) ABSTRACT

A light emitting diode (LED) module includes a plurality of LED strings and a module controller. The LED strings are connected to each other in parallel, and each of the LED strings emits light that has a different color temperature from that of the other LED strings. The module controller is configured to detect an input voltage applied to the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by the plurality of LED strings regardless of the color temperature of the light emitted by the plurality of LED strings.

16 Claims, 8 Drawing Sheets

(56) References Cited

U.S. PATENT DOCUMENTS

| | | | | |
|---|---|---|---|---|
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,735,931 | B2 | 5/2014 | Han et al. | |
| 8,766,295 | B2 | 7/2014 | Kim | |
| 9,723,681 | B2 | 8/2017 | Tsai et al. | |
| 9,756,694 | B2 | 9/2017 | Serra et al. | |
| 9,781,793 | B2 | 10/2017 | Yan et al. | |
| 2006/0273331 | A1* | 12/2006 | Lim | H05B 33/0815 257/80 |
| 2011/0115407 | A1* | 5/2011 | Wibben | H05B 33/0815 315/294 |
| 2011/0248640 | A1* | 10/2011 | Welten | H05B 33/0815 315/210 |
| 2014/0210357 | A1* | 7/2014 | Yan | H05B 33/0824 315/186 |
| 2017/0171931 | A1* | 6/2017 | Seki | H05B 33/0887 |
| 2017/0231037 | A1 | 8/2017 | Briggs | |
| 2017/0280529 | A1 | 9/2017 | Hamilton et al. | |
| 2019/0008013 | A1* | 1/2019 | Diana | H05B 33/0866 |

* cited by examiner

LED MODULE AND LIGHTING APPARATUS

CROSS-REFERENCE TO RELATED APPLICATION(S)

This application claims priority from Korean Patent Application No. 10-2018-0012259, filed on Jan. 31, 2018 in the Korean Intellectual Property Office, the disclosure of which is incorporated herein by reference in its entirety.

BACKGROUND

1. Field

The present disclosure relates to a light emitting diode (LED) module and a lighting apparatus.

2. Description of Related Art

Semiconductor light emitting devices include devices such as light emitting diodes (LEDs), and the like, and have various positive attributes, such as low power consumption, high degrees of brightness, long lifespans, and the like, and thus, the range of uses thereof, as light sources, has increased. Semiconductor light emitting devices are used as light sources in various fields. Research into the use of semiconductor light emitting devices, as well as general light emitting devices such as backlight units and lighting devices, in a variety of fields of application has been undertaken.

SUMMARY

Example embodiments provide an LED module and a lighting apparatus, in which a change in luminous flux of emitted light may be significantly reduced, while emitted light has various color temperatures that vary based on an increase or a decrease in supplied current.

According to an aspect of an example embodiment, a light emitting diode (LED) module includes a plurality of LED strings that are connected to each other in parallel, each of the plurality of LED strings being configured to emit light having a different respective color temperature, and a module controller configured to detect an input voltage applied to the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by the light source regardless of the color temperature of the light emitted by the plurality of LED strings.

According to an aspect of an example embodiment, a lighting apparatus includes a dimming signal input device configured to output a dimming signal, an LED driver configured to adjust a magnitude of a constant current output based on the dimming signal, and an LED module including a plurality of LED strings that are driven by the constant current and connected to each other in parallel, each of the plurality of LED strings being configured to emit light having a different respective color temperature, and a module controller configured to detect an input voltage applied to the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by the light source regardless of the color temperature of the light emitted by the plurality of LED strings.

According to an aspect of an example embodiment, a lighting apparatus includes an LED driver configured to supply a constant current, and an LED module including a plurality of LED strings that are driven by the constant current and connected to each other in parallel, each of the plurality of LED strings being configured to emit light having a different respective color, and a module controller configured to detect an input voltage applied to each of the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by the light source regardless of the color temperature of the light emitted by the plurality of LED strings.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, example embodiments will be described with reference to the accompanying drawings.

Figure 1:
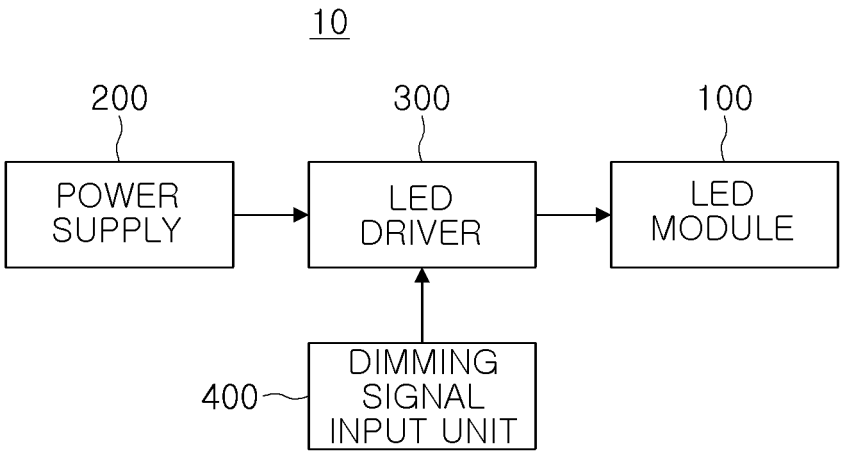
FIG. 1 is a block diagram of a lighting apparatus according to an example embodiment.

FIG. 1 is a block diagram of a lighting apparatus, according to an example embodiment.

With reference to FIG. 1, a lighting apparatus 10 according to an example embodiment may include an LED module 100, an LED driver 300, a power supply 200 and a dimming signal input unit (also referred to herein as a "dimming signal input device") 400. The LED module 100 may include a plurality of LED strings, each of which comprises a respective plurality of LEDs, and the LED driver 300 may generate driving power to drive the plurality of LEDs included in the LED module 100, by using alternating current (AC) power supplied by the power supply 200.

The LED driver 300 may be a single channel driver with only one pair of constant current supply terminals that supplies power to the LED module 100. Although the single channel driver may only control a single LED module, since a configuration thereof is relatively simplified as compared with that of a multichannel driver, a manufacturing cost thereof may be relatively low. The LED driver 300 may include any one or more of a rectifier, a converter, a controller, and the like. The rectifier may rectify an AC power supplied by the power supply 200 to convert the AC power into a direct current (DC) power. Examples of the converter may include a flyback converter, a power factor correction (PFC) converter, a buck converter, a boost convert, an LLC converter, and the like.

The controller may control the converter to output driving power appropriate for the plurality of LEDs. In an example embodiment, the controller may adjust driving power output by the converter, by controlling on and off operations of at least one switching device included in the converter, based on a clock signal having a predetermined frequency and duty ratio. The controller may receive an external control command via wired or wireless communications, and may adjust a magnitude of driving power output by the converter in response to the control command.

In addition, the LED driver 300 may adjust a magnitude of constant current output in response to a dimming voltage input via the dimming signal input unit 400, to be within a range of a rated current. For example, when a dimming voltage of 10V is input to the LED driver 300 from the dimming signal input unit 400, the LED driver 300 may maintain a rated output of 100%, and when a dimming voltage of 5V is input, the LED driver 300 may supply current of 50%, as compared with the rated output. Further, for example, when the dimming voltage decreases from 10V to 1V, the LED driver 300 may supply a current that has been reduced by 10%, as compared with the rated output, and an output voltage may be reduced by 1%. A current amount applied to the LED module 100 from the LED driver 300 may vary, based on a dimming voltage of the dimming signal input unit 400, and thus, a forward voltage applied to the LED module 100 may vary. The LED module 100 may detect the forward voltage applied by the LED driver 300 in real time, and may control the amount of current supplied to each respective one of the plurality of LED strings based on a magnitude of the detected forward voltage, thereby providing light having various color temperatures while maintaining a uniform luminous flux.

In general, even when the same amount of current is supplied to LEDs, levels of luminous flux of light that are emitted based on color temperatures of the LEDs may be different from each other. For example, levels of luminous flux of light respectively emitted by LEDs having color temperatures of 2700K, 3000K, 3500K, 4000K and 5000K may be measured as 101.5%, 103%, 106.1% and 109.1%, respectively, when light emitted by an LED having 2700K of color temperature is 100%. Thus, luminous flux has a trend of increasing proportionally with respect to a color temperature of light emitted by an LED. For example, an LED having a color temperature of 5000K may have a luminous flux about 9% higher as compared with an LED having 2700K of color temperature, even when the same amount of current is supplied.

Thus, a forward voltage applied by the LED driver 300 may be detected based on an input signal of the dimming signal input unit 400, and ratios of currents applied to a plurality of LED strings having different color temperatures, respectively, may be adjusted based on a value at which a voltage increases or decreases, thereby changing a color temperature while maintaining luminous flux. In the case of the related art, a relatively high cost dimming signal input unit should be configured in order to change a color temperature of an LED lighting apparatus. However, in the case of an LED lighting apparatus according to an example embodiment, a color temperature of the LED lighting apparatus may be changed by using the dimming signal input unit 400 which includes a passive device or a battery, thereby providing an LED lighting apparatus of which a cost is relatively low, while enabling a color temperature to be changed.

In addition, an LED having a relatively low color temperature may maintain the same amount of luminous flux when a relatively large amount of current is supplied, as compared with an LED having a relatively high color temperature. For example, the LED having a relatively high color temperature may obtain the same amount of luminous flux even when a relatively small amount of current is supplied as compared with that of the LED having a relatively low color temperature. Thus, for example, even in a case in which an amount of current supplied to the LED is reduced, the luminous flux of the LED module may be maintained at a constant value.

Figure 6:
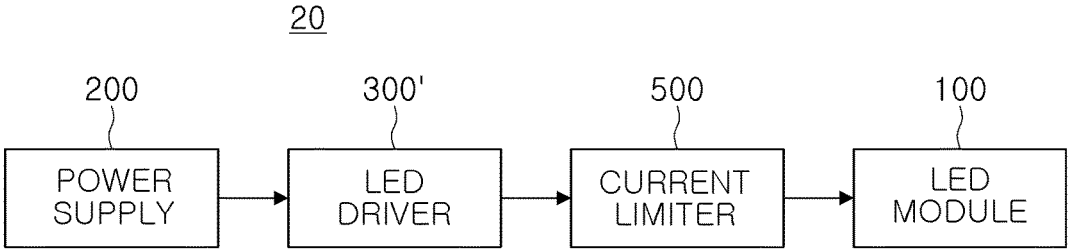
FIG. 6 is a block diagram of a lighting apparatus according to another example embodiment.

FIG. 6 is a is a block diagram of a lighting apparatus 20 according to another example embodiment. As compared with the lighting apparatus 10 of FIG. 1, a separate terminal that is configured to receive a dimming signal is not present in an LED driver 300' of the lighting apparatus 20. Thus, a current limiter 500 may be disposed between the LED driver 300' and an LED module 100, in order to adjust a magnitude of constant current supplied by the LED driver 300'. The current limiter 500 may be configured to have a wireless communication function and to adjust a color temperature of light emitted by the LED module 100 by remotely changing a setting of the current limiter 500.

Figure 7:
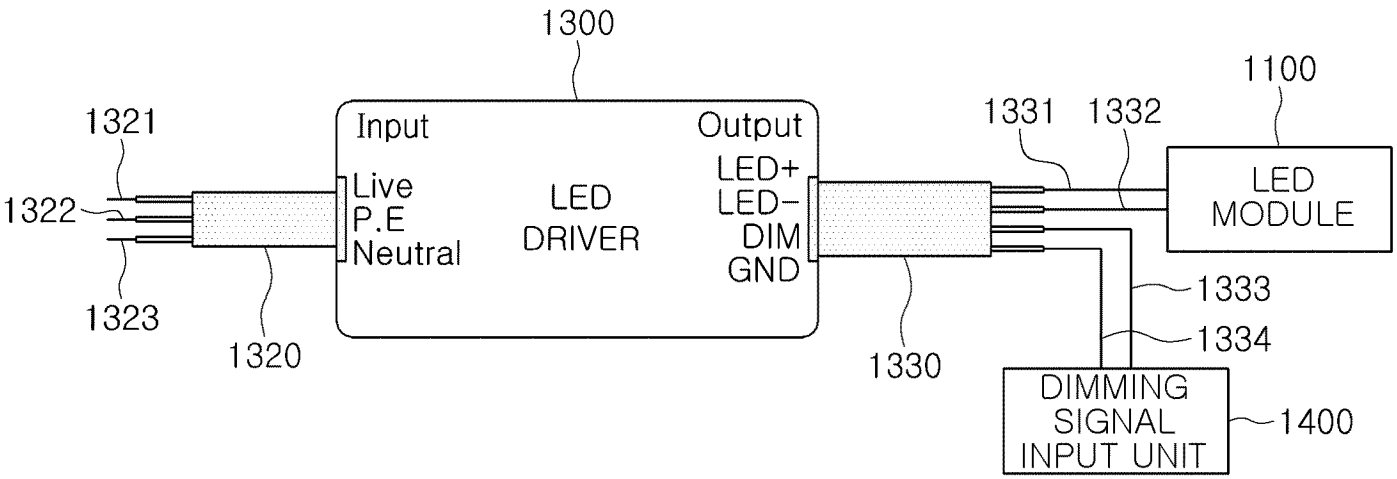
FIG. 7 is a diagram of an LED driver according to an example embodiment.
Figure 8:
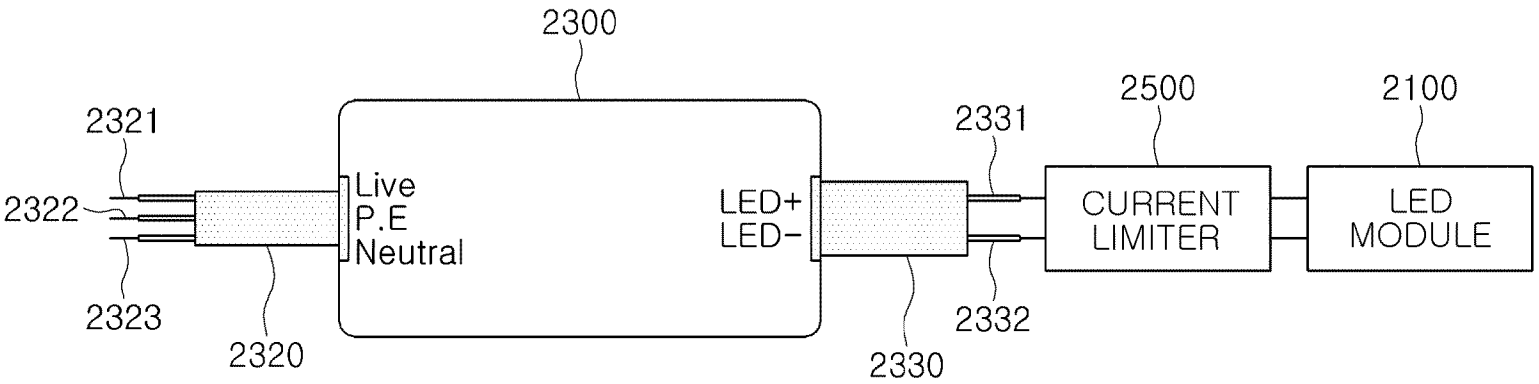
FIG. 8 is a diagram of an LED driver according to another example embodiment.

FIG. 7 is a diagram of an LED driver according to an example embodiment, and FIG. 8 is a diagram of an LED driver according to another example embodiment.

Referring to FIG. 7, an LED driver 1300 according to an example embodiment may include a first harness 1320 and a second harness 1330. The first harness 1320 may include a plurality of input terminals 1321, 1322, and 1323 configured to receive alternating current power, and the second harness 1330 may include a plurality of output terminals 1331 and 1332 configured to transmit driving power generated by the LED driver 1300 to the LED module 1100. In addition, the second harness 1330 may include a plurality of input terminals 1333 and 1334 configured to receive a dimming signal from a dimming signal input unit 1400. The LED driver 1300 may be waterproof and/or dustproof, depending on fields of application. In an example embodiment, the LED driver 1300 may be sealed by a sealing member that is capable of blocking the infiltration of moisture, dust or the like.

Referring to FIG. 8, an LED driver 2300 according to an example embodiment may include a first harness 2320 and a second harness 2330. Similarly as described above with respect to the example embodiment of FIG. 7, the first harness 2320 may include a plurality of input terminals 2321, 2322, and 2323 configured to receive alternating current power, and the second harness 2330 may include a plurality of output terminals 2331 and 2332 configured to transmit driving power generated by the LED driver 2300 to an LED module 2100. In addition, unlike the example embodiment of FIG. 7, an input terminal configured to receive a dimming signal may not be present in the LED driver 2300. Thus, a current limiter 2500 may be disposed between the LED driver 2300 and the LED module 2100 in order to adjust a magnitude of constant current supplied by the LED driver 2300.

Figure 2:
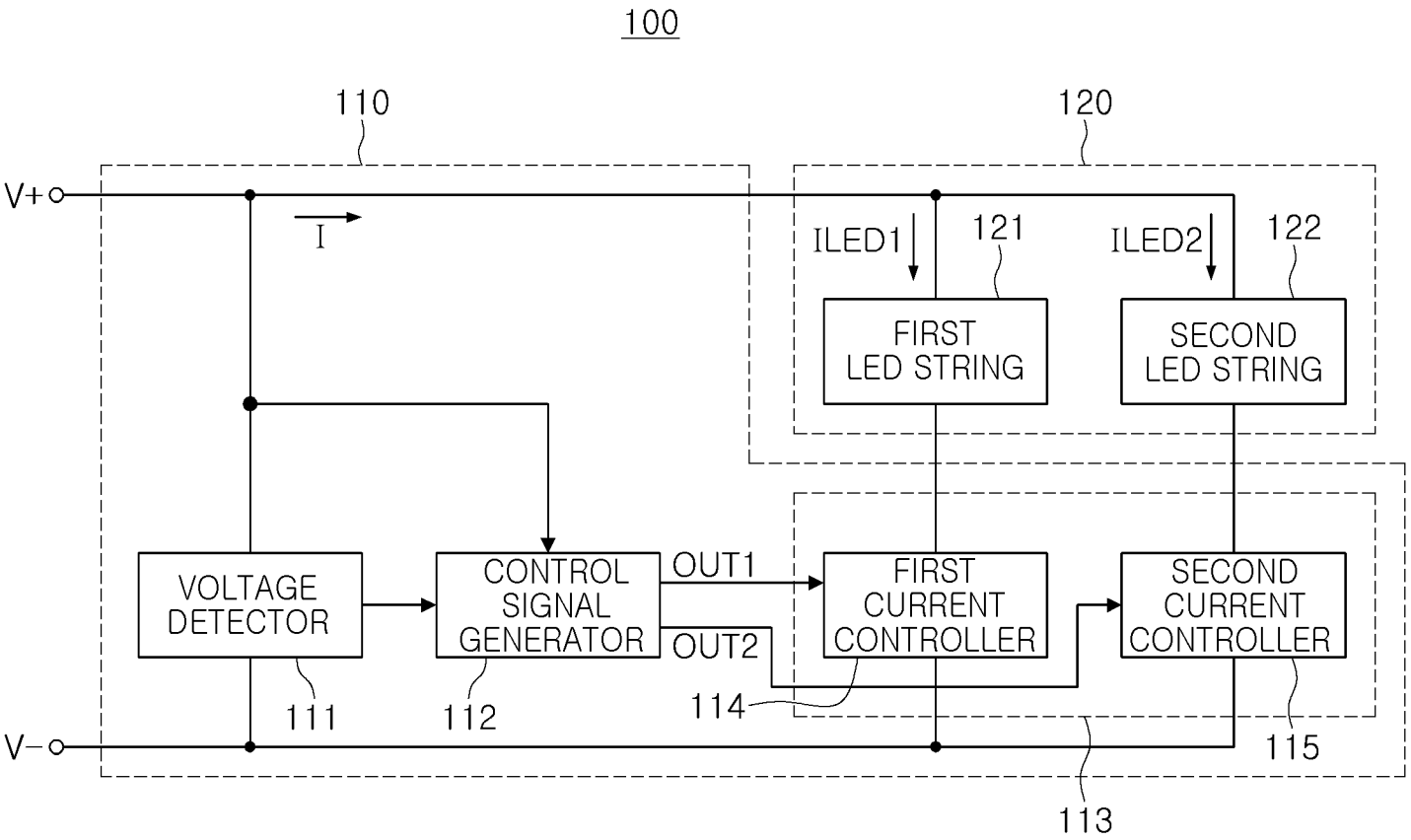
FIG. 2 is a block diagram of an LED module according to an example embodiment.
Figure 9:
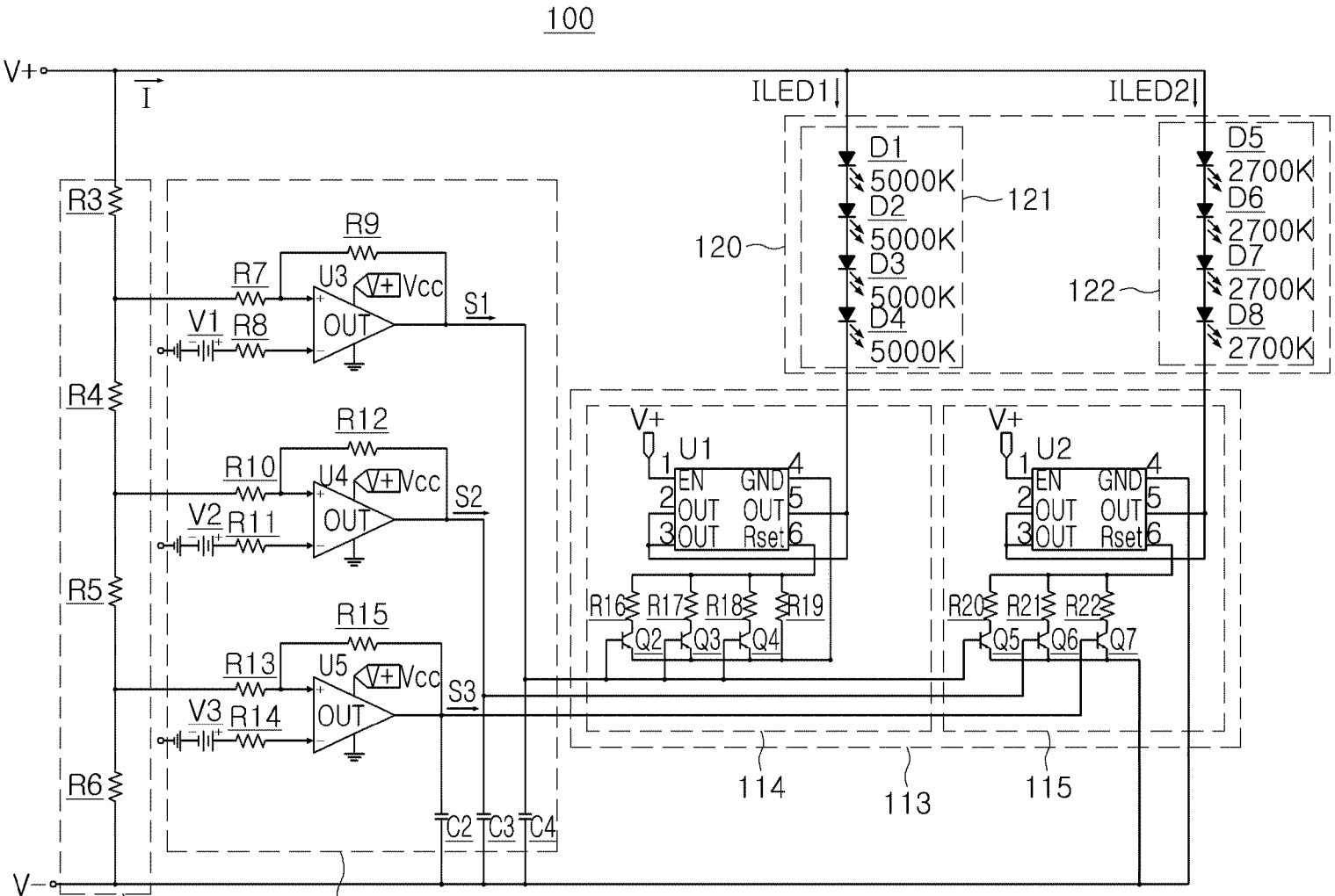
FIG. 9 is a diagram provided to illustrate operations of the LED module of FIG. 2.

FIG. 2 is a block diagram of an LED module, according to an example embodiment. FIG. 9 is a diagram provided to illustrate operations of the LED module of FIG. 2.

With reference to FIG. 2, the LED module 100 according to an example embodiment may include a light source unit (also referred to herein as a "light source") 120 including a plurality of LED strings 121 and 122, each of which is configured to emit light that has a different respective color temperature, and a module controller 110 configured to perform controlling to significantly reduce a change in a luminous flux of light, while changing a color temperature of light emitted by the light source unit 120, by controlling ratios of currents respectively supplied to each of the plurality of LED strings 121 and 122.

The light source unit 120 may include the plurality of LED strings 121 and 122 which are electrically connected to each other in parallel. Each of the plurality of LED strings 121 and 122 may include one or more LEDs, and for example, each of the plurality of LED strings 121 and 122 includes a respective plurality of LEDs, each respective plurality of LEDs may be connected in series. As illustrated in FIG. 9, the example embodiment illustrates a case in which the light source unit 120 includes the first and second LED strings 121 and 122, the first LED string 121 includes first LED D1, second LED D2, third LED D3, and fourth LED D4, which are connected in series, and the second LED string 122 includes fifth LED D5, sixth LED D6, seventh LED D7, and eight LED D8 which are also connected in series, by way of example. Although the example embodiment provides an example in which the light source unit 120 includes the first and second LED strings 121 and 122, an example embodiment thereof is not limited thereto. For example, the light source unit 120 may include three or more LED strings that have different color temperatures.

The first and second LED strings 121 and 122 may emit light having different color temperatures. In this case, the first to fourth LEDs D1 to D4 constituting the first LED string 121 may be LEDs that emit light having the same color temperature that is a first color temperature. The fifth to eighth LEDs D5 to D8 constituting the second LED string 122 may be LEDs that emit light having the same color temperature that is a second color temperature which is different from the first color temperature. In this case, the same color temperature refers to color temperatures that may be regarded as being within substantially the same range, rather than exactly the same color temperature.

Thus, the first and second LED strings 121 and 122 may emit light having different color temperatures. In this case, the plurality of LEDs constituting each of the first and second LED strings 121 and 122 may be comprised of LEDs emitting light having the same respective color temperature. According to an example embodiment, a case in which a first color temperature of light emitted by the first LED string 121 is 5000K, and a case in which a second color temperature of light emitting by the second LED string 122 is 2700K, may be provided as the example. For example, the case in which the second color temperature is lower than the first color temperature is described as an example.

The module controller 110 may perform controlling to detect an input voltage V applied to the first and second LED strings 121 and 122, adjust ratios of currents ILED1 and ILED2 supplied to the first and second LED strings 121 and 122, respectively, based on the input voltage V, thereby adjusting a color temperature of light emitted by the light source unit 120. In this case, the module controller 110 may perform controlling in such a manner that while the color temperature of light emitted by the light source unit 120 is adjusted, a change in luminous flux of light emitted regardless of such an adjustment may be significantly reduced.

The module controller 110 may include a voltage detector 111 configured to detect the input voltage V input to the module controller 110, a control signal generator 112 configured to output first and second current control signals OUT1 and OUT2 in order to adjust ratios of the currents ILED1 and ILED2 supplied to the first and second LED strings 121 and 122, respectively, and a current controller 113 configured to control the currents ILED1 and ILED2 supplied to the first and second LED strings 121 and 122, respectively.

Figure 3:
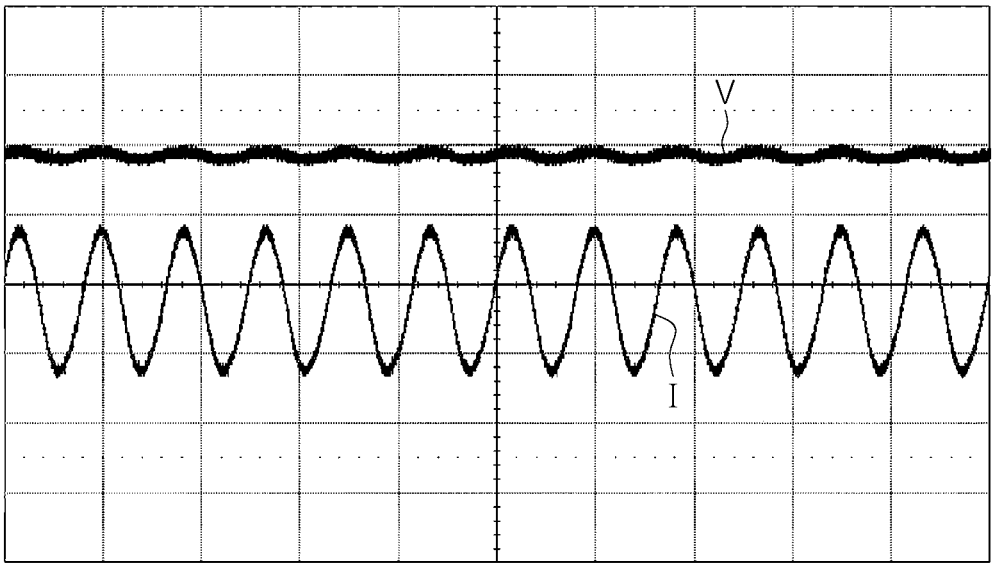
FIG. 3 is a diagram comparing ripples of an input voltage and an input current of FIG. 2.

The voltage detector 111 may detect the input voltage V between an input terminal V+ and an output terminal V− of the module controller 110 in real time and output the detected voltage to the control signal generator 112. The voltage detector 111 may include a plurality of resistors that are connected in series between the input terminal V+ and the output terminal V− of the module controller 110. The input voltage V may be a forward voltage Vf applied to the first and second LED strings 121 and 122. As such, in the case of the method of detecting the input voltage V applied to the module controller 110 and adjusting ratios of the currents supplied to the first and second LED strings 121 and 122, based on the detected input voltage V, power consumption and heat generation may be reduced, as compared to a method of detecting an input current I applied to the module controller 110 and controlling ratios of currents supplied to the first and second LED strings 121 and 122 based on the detected input current I. Further, malfunctions of the module controller 110 may be prevented from occurring as a result. Generally, the input current I is measured by connecting a resistor to an output terminal V− in series, which causes power consumption and heat generation. Further, as illustrated in FIG. 3, a ripple of the input current I has a much greater value than that of a ripple of the input voltage V. In an example, the input current I was measured to have a ripple of about 36% when an effective value was 1.445 A. However, a ripple of the input voltage V was measured to have a ripple of about 5% when the effective value of the input voltage V was 28.16V. If the ripple is relatively large, since a difference between a maximum value and a minimum value of the detected value is relatively great, there may be a relatively high probability that the control signal generator 112 operated by the detected value will malfunction. Thus, as the input voltage V is detected, and based on the detected input voltage V, the control signal generator 112 controls the current supplied to the first and second LED strings 121 and 122, and the possibility of malfunction of the module controller 110 may be relatively reduced.

The control signal generator 112 may detect a voltage variation by comparing the input voltage V detected by the voltage detector 111 with a reference voltage, and may output the first and second current control signals OUT1 and OUT2 which respective control first and second current controllers 114 and 115. The first and second current control signals OUT1 and OUT2 may be generated in any of various forms, such as direct current (DC), pulse width modulation (PWM), and ramp waveform, or the like. For example, the control signal generator 112 may compare a divided voltage detected from a node between the plurality of resistors constituting the voltage detector 111 with the reference voltage, and may output the current control signal, based on the comparison result. The control signal generator 112 may include an operational amplifier that includes a non-inverting terminal to which the divided voltage is input, and an inverting terminal to which the reference voltage is applied, and is configured to output a current control signal by comparing the divided voltage with the reference voltage. In addition, the control signal generator 112 may include a resistor that is connected between the non-inverting terminal and an output terminal of the operational amplifier. According to an example embodiment, the current controller 113 may further include a switch to completely turn off the first and second LED strings 121 and 122. The control signal generator 112 may be configured to further output a control signal to turn on and off the switching unit.

By controlling ratios of currents supplied to the first and second LED strings 121 and 122, on the basis of the first and second current control signals OUT1 and OUT2 output from the control signal generator 112, the current controller 113 may adjust a color temperature of light emitted by the light source unit 120, by respectively controlling ratios of luminous flux of the first and second color temperatures, while significantly reducing a change in luminous flux of light emitted by the first and second LED strings 121 and 122 or maintaining luminous flux of the light to be constant.

The current controller 113 may include first and second current controllers 114 and 115, which are respectively configured to control first and second driving currents ILED1 and ILED2 supplied to the first and second LED strings 121 and 122.

The current controllers 113, for example, the first and second current controllers 114 and 115, may include constant current devices which are respectively connected to output terminals of the first and second LED strings 121 and 122 and configured to control a current supplied to the plurality of LED strings. Further, the current controllers 113, for example, the first and second current controllers 114 and 115, may include a plurality of resistors connected to control terminals of the constant current devices in parallel, respectively, such that output terminals of the resistors are connected to a plurality of switching devices turned on and off in response to a current control signal of the current controller 113.

For example, when the input voltage V decreases, the current controller 113 may control the first current controller 114 to increase the first driving current ILED1 supplied to the first LED string 121, and may control the second current controller 115 to reduce the second driving current ILED2 supplied to the second LED string 122, thereby changing a color temperature of light while significantly reducing an amount of change in luminous flux of light emitted from the light source unit 120. Thus, as a magnitude of the constant current supplied by the LED driver 300 is adjusted by a dimming signal received from the dimming signal input unit 400, the input voltage V applied to the LED module 100 may be adjusted, and thus, the first and second driving currents ILED1 and ILED2 applied to the first and second LED strings 121 and 122, respectively, may be adjusted based on the change in the input voltage V. Thus, the color temperature of light may be changed while significantly reducing the amount of change in luminous flux of light emitted by the light source unit 120.

Table 1 below shows results of measurements of changes in color temperatures, without a change in luminous flux, by adjusting ratios of the first and second driving currents ILED1 and ILED2 supplied to the first and second LED strings 121 and 122, respectively, based on a change in supply current I supplied by the LED driver 300.

TABLE 1

| Supply Current (I) (mA) | First Driving Current (ILED1) | Second Driving Current (ILED2) | Color Temperature (K) | Luminous Flux (lm) |
|---|---|---|---|---|
| 700 | 700 | 0 | 2700 | 1000 |
| 690 | 550 | 140 | 3000 | 1000 |

TABLE 1-continued

| Supply Current (I) (mA) | First Driving Current (ILED1) | Second Driving Current (ILED2) | Color Temperature (K) | Luminous Flux (lm) |
|---|---|---|---|---|
| 680 | 480 | 200 | 3500 | 1000 |
| 660 | 400 | 260 | 4000 | 1000 |
| 640 | 0 | 640 | 5000 | 1000 |

Figure 4:
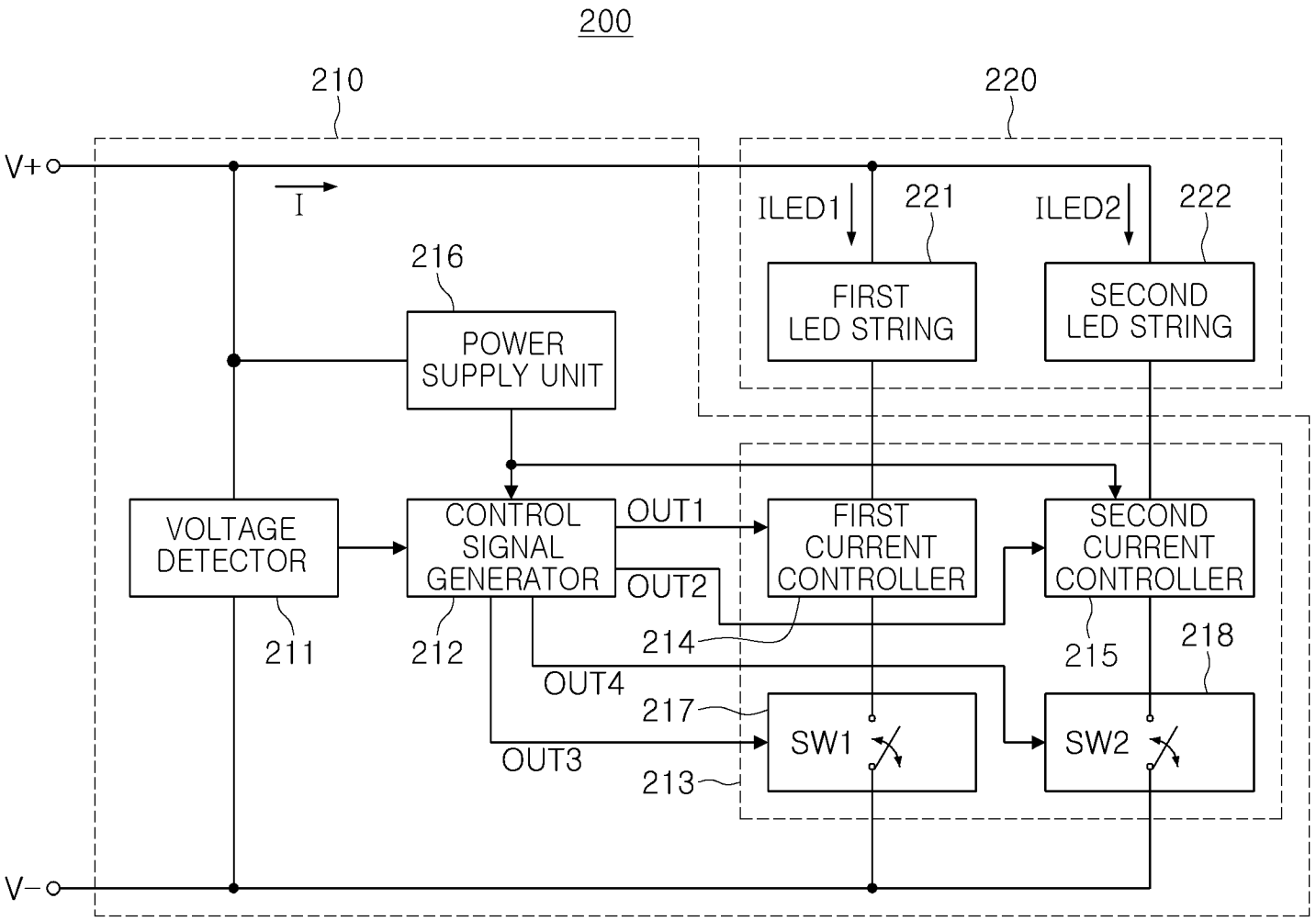
FIGS. 4 and 5 are block diagrams of LED modules according to various example embodiments.
Figure 5:
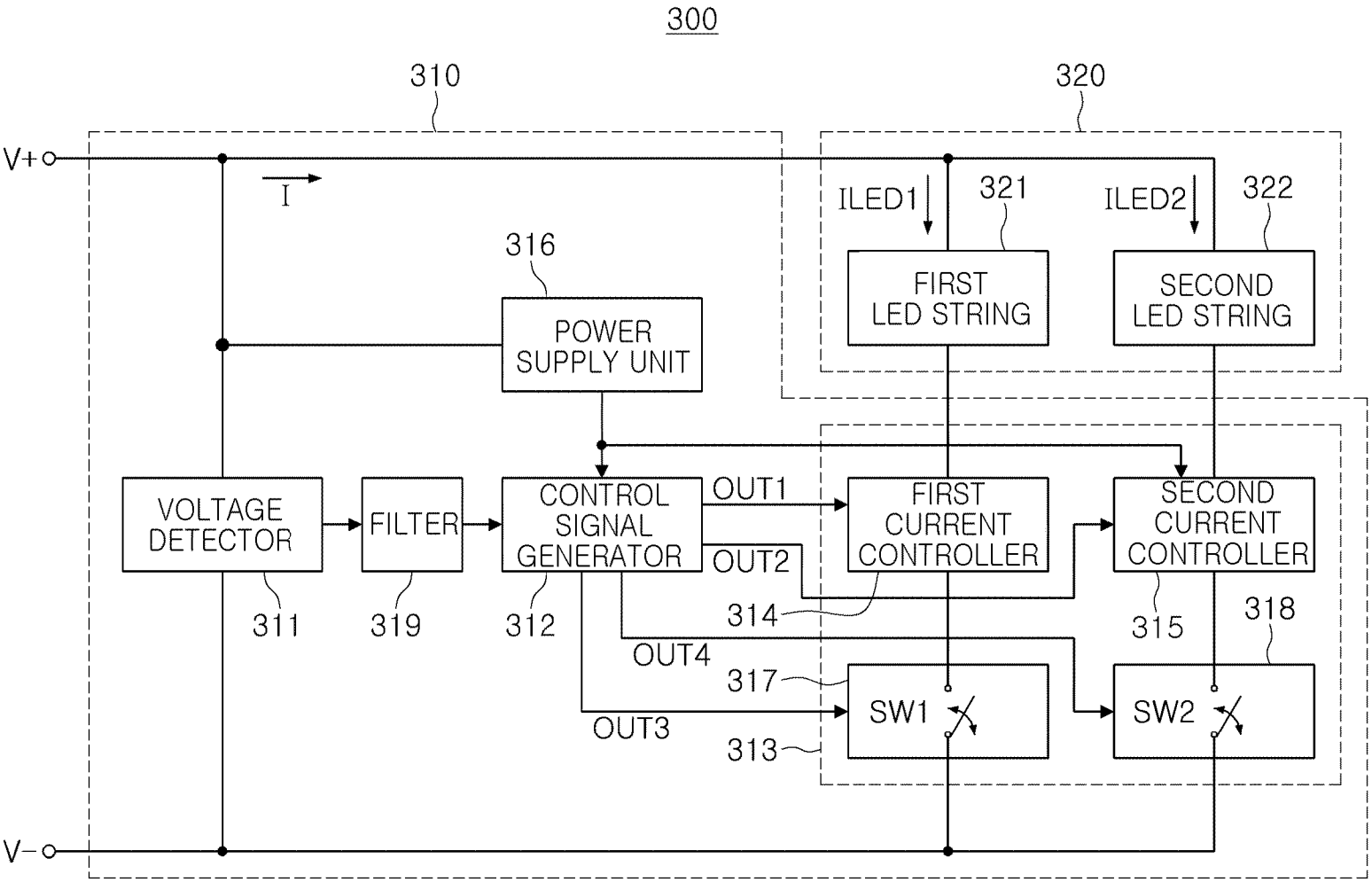

FIGS. 4 and 5 are block diagrams of LED modules, according to example embodiments.

Referring to FIG. 4, an LED module 200 according to an example embodiment may include a module controller 210 and a light source unit 220, similarly to the foregoing example embodiment. The module controller 210 may include a voltage detector 211, a control signal generator 212, and a current controller 213. The current controller 213 may include first and second current controllers 214 and 215. Descriptions of configurations identical to those of the foregoing example embodiment will be omitted to avoid redundancy of descriptions.

FIG. 4 illustrates a case in which a power supply 216 and first and second switches 217 and 218 are added to the configuration of the foregoing example embodiment. The power supply 216 may be provided to apply a bias voltage to each of the control signal generator 212 and the current controller 213. For example, in a case in which an output voltage from an LED driver 300 is relatively high, an electronic component constituting the control signal generator 212 may be damaged. Since the power supply 216 may constantly supply power to the control signal generator 212, the control signal generator 212 may be prevented from being damaged. The first and second switches 217 and 218 may be switches which are configured to block a current from being supplied to first and second strings 221 and 222, to completely turn off the first and second strings 221 and 222. On and off operations of the first and second switches 217 and 218 may be controlled by third and fourth current control signals OUT3 and OUT4 outputted by the control signal generator 212.

Then, with reference to FIG. 5, an LED module 300 according to an example embodiment may include a module controller 310 and a light source unit 320, similarly to the foregoing example embodiment. The module controller 310 may include a voltage detector 311, a control signal generator 312 and a current controller 313. The current controller 313 may include first and second current controllers 314 and 315, and may include a power supply 316 and first and second switches 317 and 318. Descriptions of configurations the same as those of the foregoing example embodiment will be omitted to avoid redundancy.

The example embodiment of FIG. 5 illustrates the case in which a filter 319 is added to the configuration of the foregoing example embodiment. The filter 319 may be a low pass filter (LPF) configured to remove noise that may be output from the voltage detector 311. For example, in a case in which switching noise is included in an output voltage of the LED driver 300, the filter 319 may remove the noise so as to improve reliability of an input voltage V detected from the voltage detector 311.

FIG. 9 is a diagram provided to illustrate operations of the LED module of FIG. 2, according to an example embodiment. The operations of the LED module 100 of FIG. 2 will be described with reference to FIG. 9.

The voltage detector 111 may detect the voltage V between the input terminal V+ and the output terminal V− of the module controller 110 in real time, and may output the detected voltage V to the control signal generator 112. The voltage detector 111 may include a plurality of resistors R3, R4, R5, and R6 which are connected in series between the input terminal V+ and the output terminal V−. The plurality of resistors R3 to R6 may divide the applied voltage V into divided voltages, such that the magnitude of voltages input to noninverting terminals of first, second, and third operational amplifiers U3, U4, and U5 of the control signal generator 112 may be respectively adjusted.

The control signal generator 112 may include the first, second, and third operational amplifiers U3, U4, and U5, a plurality of resistors R7, R8, R9, R10, R11, R12, R13, R14, and R15, and first, second, and third voltage sources V1, V2, and V3 which provide a reference voltage. The first, second, and third operational amplifiers U3, U4, and U5 may compare the divided voltages of the voltage detector 111 input through the non-inverting terminals with the reference voltage input through an inverting terminal, thereby outputting first, second, and third control signals S1, S2, and S3, which constitute the first and second current control signals OUT1 and OUT2 to control the first and second current controllers 114 and 115, respectively. The first, second, and third operational amplifiers U3, U4, and U5 may constitute feedback circuits, by using resistors R9, R12 and R15 which connect the non-inverting terminals and the output terminals, respectively, to apply hysteresis thereto. Thus, erroneous operations, in which on and off operations are repeated unendingly in a specific voltage region, may be prevented. The hysteresis may also be implemented by a Schmitt-trigger inverter in addition to an operational amplifier.

The first, second, and third control signals S1, S2, and S3 may control current amounts of the first and second driving currents ILED1 and ILED2 flowing through first and second constant current devices U1 and U2 connected to output terminals of the first and second LED strings 121 and 122, by turning switching devices Q2, Q3, Q4, Q5, Q6, and Q7 on and off to be connected in series to a plurality of resistors R16, R17, R18, R19, R20, R21, and R22 which are connected to control terminals of the first and second LED strings 121 and 122 in parallel, respectively. As the first and second constant current devices U1 and U2, any of various types of control integrated circuits (ICs), using a method such as a linear control method, a PWM method or the like, may be used.

As set forth above, according to an example embodiment, an LED module and a lighting apparatus, in which a change in luminous flux of emitted light may be significantly reduced, while emitted light has various color temperatures based on an increase or a decrease in supplied current, by controlling a ratio of a current supplied to a plurality of LED strings having different color temperatures based on an amount of current supplied to an LED module, may be provided.

While example embodiments have been shown and described above, it will be apparent to those skilled in the art that modifications and variations may be made without departing from the scope of the present disclosure as defined by the appended claims.

What is claimed is:

1. A light emitting diode (LED) module comprising:

a plurality of LED strings that are connected to each other in parallel, each of the plurality of LED strings being configured to emit light that has a different respective color temperature; and a module controller configured to detect an input voltage applied to the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by a combination of all the plurality of LED strings based on the adjusted ratio of the current respectively supplied to each of the plurality of LED strings, regardless of the color temperature of the light emitted by the plurality of LED strings, wherein the module controller comprises:

a voltage detector configured to detect the input voltage;

a control signal generator configured to output a current control signal to adjust the ratio of the current respectively supplied to each of the plurality of LED strings based on a comparison of the input voltage with a reference voltage; and a current controller configured to control the current respectively supplied to each of the plurality of LED strings based on the current control signal, wherein the voltage detector comprises a plurality of first resistors which are connected in series between an input terminal of the module controller and an output terminal of the module controller, wherein the control signal generator is further configured to output the current control signal based on a comparison of a divided voltage detected from a node between the plurality of first resistors with the reference voltage, and wherein the control signal generator comprises:

an operational amplifier comprising a non-inverting terminal configured to receive the divided voltage and an inverting terminal configured to receive the reference voltage, the operational amplifier being configured to output the current control signal by comparing the divided voltage with the reference voltage; and a resistor that is connected between the non-inverting terminal and an output terminal of the operational amplifier.

2. The LED module of claim 1, wherein the module controller is further configured to maintain the luminous flux of the light emitted by the combination of all the plurality of LED strings to be constant.

3. The LED module of claim 1, wherein the current controller comprises:

a constant current device connected a respective output terminal of each of the plurality of LED strings and configured to control the current respectively supplied to each of the plurality of LED strings;

a plurality of switching devices connected to a control terminal of the constant current device in parallel and configured to be turned on and off based on the current control signal; and a plurality of second resistors, each of the plurality of second resistors comprising an output terminal which is connected to respective one of the plurality of switching devices.

4. The LED module of claim 1, wherein the plurality of LED strings comprises a first LED string configured to emit light having a first color temperature and a second LED string configured to emit light having a second color temperature that is lower than the first color temperature.

5. The LED module of claim 4, wherein the current controller comprises a first current controller configured to control a first current supplied to the first LED string and a second current controller component configured to control a second current supplied to the second LED string.

6. The LED module of claim 5, wherein the module controller is further configured to, based on in the input voltage decreasing, increase the first current by controlling the first current controller and to decrease the second current by controlling the second current controller.

7. The LED module of claim 1, wherein the module controller further comprises a switch connected to an output terminal of the current controller, and wherein the switch is configured to be turned on and off based on the current control signal.

8. The LED module of claim 1, further comprising a power supply configured to apply a bias voltage to each of the control signal generator and the current controller.

9. The LED module of claim 1, further comprising a filter connected between the control signal generator and the current controller.

10. The LED module of claim 1, wherein the input voltage is a forward voltage applied to the plurality of LED strings.

11. A lighting apparatus comprising:

a dimming signal input device configured to output a dimming signal;

a light emitting diode (LED) driver configured to adjust a magnitude of a constant current output based on the dimming signal; and an LED module comprising:

a plurality of LED strings that are driven by the constant current and connected to each other in parallel, each of the plurality of LED strings being configured to emit light that has a different respective color temperature; and a module controller configured to detect an input voltage applied to the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by a combination of all the plurality of LED strings based on the adjusted ratio of the current respectively supplied to each of the plurality of LED strings, regardless of the color temperature of the light emitted by the plurality of LED strings, wherein the module controller comprises:

a voltage detector configured to detect the input voltage;

a control signal generator configured to output a current control signal to adjust the ratio of the current respectively supplied to each of the plurality of LED strings based on a comparison of the input voltage with a reference voltage; and a current controller configured to control the current respectively supplied to each of the plurality of LED strings based on the current control signal, wherein the voltage detector comprises a plurality of first resistors which are connected in series between an input terminal of the module controller and an output terminal of the module controller, wherein the control signal generator is further configured to output the current control signal based on a comparison of a divided voltage detected from a node between the plurality of first resistors with the reference voltage, and wherein the control signal generator comprises:

an operational amplifier comprising a non-inverting terminal configured to receive the divided voltage and an inverting terminal configured to receive the reference voltage, the operational amplifier being configured to output the current control signal by comparing the divided voltage with the reference voltage; and a resistor that is connected between the non-inverting terminal and an output terminal of the operational amplifier.

12. The lighting apparatus of claim 11, wherein each of the plurality of LED strings comprises a respective plurality of LED devices that connected in series.

13. A lighting apparatus comprising:

a light emitting diode (LED) driver configured to supply a constant current; and an LED module comprising:

a plurality of LED strings that are driven by the constant current and connected to each other in parallel, each of the plurality of LED strings being configured to emit light that has a different respective color temperature; and a module controller configured to detect an input voltage applied to the plurality of LED strings, adjust a color temperature of the light emitted by the plurality of LED strings by adjusting a ratio of current respectively supplied to each of the plurality of LED strings based on the input voltage, and reduce a change in a luminous flux of the light emitted by a combination of all the plurality of LED strings based on the adjusted ratio of the current respectively supplied to each of the plurality of LED strings, regardless of the color temperature of the light emitted by the plurality of LED strings, wherein the module controller comprises:

a voltage detector configured to detect the input voltage;

a control signal generator configured to output a current control signal to adjust the ratio of the current respectively supplied to each of the plurality of LED strings based on a comparison of the input voltage with a reference voltage; and a current controller configured to control the current respectively supplied to each of the plurality of LED strings based on the current control signal, wherein the voltage detector comprises a plurality of first resistors which are connected in series between an input terminal of the module controller and an output terminal of the module controller, wherein the control signal generator is further configured to output the current control signal based on a comparison of a divided voltage detected from a node between the plurality of first resistors with the reference voltage, and wherein the control signal generator comprises:

an operational amplifier comprising a non-inverting terminal configured to receive the divided voltage and an inverting terminal configured to receive the reference voltage, the operational amplifier being configured to output the current control signal by comparing the divided voltage with the reference voltage; and a resistor that is connected between the non-inverting terminal and an output terminal of the operational amplifier.

14. The lighting apparatus of claim 13, wherein the LED driver comprises a single channel constant current supply terminal.

15. The lighting apparatus of claim 13, further comprising a current limiter connected between the LED driver and the LED module and configured to regulate the constant current.

16. The lighting apparatus of claim 13, wherein each of the plurality of LED strings comprises a respective plurality of LED devices that are connected in series.

* * * * *